United States Patent [19]

Haus, Jr. et al.

[11] 4,155,232

[45] May 22, 1979

[54] MULTI-COMBINATION SECURITY LOCK AND KEY

[76] Inventors: Paul Z. Haus, Jr., 787 Hartwell St., Teaneck, N.J. 07666; John A. Signorelli, 2150 E. 29th St., Brooklyn, N.Y. 11229

[21] Appl. No.: 871,958

[22] Filed: Jan. 24, 1978

[51] Int. Cl.[2] ..... E05B 67/36

[52] U.S. Cl. ..... 70/34; 70/395

[58] Field of Search ..... 70/14, 32, 33, 34, 386, 70/395, 397, 398

[56] References Cited

U.S. PATENT DOCUMENTS

| | | | |
|---|---|---|---|
| 4,040,279 | 8/1977 | Signorelli | 70/34 |
| 4,058,992 | 11/1977 | Nielsen | 70/34 |

*Primary Examiner*—Robert L. Wolfe

*Attorney, Agent, or Firm*—Brooks, Haidt, Haffner & Delahunty

[57] ABSTRACT

A plunger-type (barrel) lock has a spring loaded plunger which can only be properly retracted by the use of a key having a central rod, enlarged end sliding member and outwardly moving fingers for gripping engagement within a socket (cylinder bore) of the plunger. A movable, spring-biased eyelet is positioned adjacent the socket, such that an unauthorized key or tampering tool will grip the eyelet, rather than the plunger socket, failing to open the lock. The key has a toggle type operating lever including a tension relief element in the form of a spring, coacting with an internal collar of the key to allow some axial movement of the key's operating elements. Use of the collar allowing axial movement of the key's operating elements and complementing socket diameter of the plunger within the lock can provide security lock combinations for the user(s).

17 Claims, 6 Drawing Figures

MULTI-COMBINATION SECURITY LOCK AND KEY

BACKGROUND OF THE INVENTION

1. Field of the Invention

The invention relates to plunger-type or barrel-type locks and keys.

2. Description of the Prior Art

Locks having internal spring-loaded axially movable plungers and radially extending locking members such as steel balls, are widely used to prevent tampering with gas and electric meters. Examples of such locks, called generally plunger-type locks throughout this specification are shown in U.S. Pat. Nos. 1,923,025 and 3,714,802 to Morse et al; 3,002,368 and 3,033,016 to Moberg; 3,478,548 to Finck; and 3,835,674 to Hoyt. The locks of all of the foregoing patents are intended to prevent unlocking by any means other than the proper key. The ingenuity and resourcefulness of those who seek unauthorized access to electric and gas meters and shutoff switches and valves, learned through sad experience by utility companies, have been countered by advances in the technology of locks of the plunger-type.

Morse et al U.S. Pat. No. 1,923,025 shows a plunger-type lock and key in which threads on the key mate with internal threads of a spring-loaded plunger for retraction of the plunger.

The lock of Moberg U.S. Pat. No. 3,002,368 was designed to be opened with a key shown in Moberg U.S. Pat. No. 3,033,016, which has a pair of fingers that are spread apart within a bore of the lock's plunger to engage frictionally and permit retraction of the plunger. The Moberg key has a cam lever.

Morse et al U.S. Pat. No. 3,714,802, noting that the locks of the Morse et al and Moberg patents discussed above have been attacked with occasional success by the use of a wire with a return bend at its end, proposed the insertion of a relatively free and slidable sleeve within the axial bore of the lock plunger to thwart bent-wire lock-pickers by requiring a greater degree of radially expanding force. This patent also suggests limiting the depth of the bore in the lock's plunger.

Finck U.S. Pat. No. 3,478,548 relates a draw key intended to be useful in unlocking plunger-type locks having various kinds of plungers.

Hoyt U.S. Pat. No. 3,835,674 is directed to defense against the lock picker who hammers a nail into the plunger bore of the previously described locks and thus attains sufficient engagement to retract the plunger and free the locking balls to open the lock. Hoyt's plunger is made in two parts, one of which must be retracted while the other remains in place to open the lock so that the nail-hammering lock-picker would wedge both parts together and retract both parts in an attempt to tamper with a meter. The piece which is to be left behind in opening Hoyt's lock has a conical point facing the keyhole. However, the limited cavity provided by the plunger bore of the Hoyt lock makes gripping the plunger, even with the authorized key difficult, especially if someone has damaged the lock by attempting to pick it. If the conical point on the central member of Hoyt's lock has been bent over to engage the cylinder by a hammering lock-picker, even the authorized key cannot open the lock. Foreign matter can lodge in the bore of Hoyt's lock, hampering operation and preventing opening of the lock with its proper key, so that when an authorized person removes the lock, he may be required to destroy parts held by the lock.

It has also been found that some locks using keys of the internal frictional engagement type can be opened by means of a device of the type shown in U.S. Pat. No. 1,656,180, and though the casual tamperer probably does not have such a tool, it is available and may be used by the more experienced practitioner of the lock-picking art.

The prior art locks will succumb to brute force of sufficient violence or to some combination of skill and luck on the part of the lock-picker, but entirely aside from these problems is the unauthorized possession and use of the key designed for the lock. The loss or theft of a key exposes to unauthorized entry the many locks for which the key is intended, and despite vigilance in restricting access to keys, there have been cases in which keys have been unlawfully used.

The security problem of lost and stolen keys has been difficult to combat because not only those who must open the lock but also those who install locks of the prior art types discussed by way of example, ordinarily have authorized keys for the locks. Because personnel are required to have keys for the prior art locks, control, record keeping and administration related to the keys has been difficult.

The foregoing drawbacks of conventional plunger-type lock and key systems evidence the present need for a pick resistant plunger-type lock that cannot be opened by existing keys, but which can be opened by means of a key which will also open existing locks, facilitating a "master key" concept and multi-combination capability to restrict usage in territorial areas.

Our prior U.S. Pat. No. 4,040,279, issued Aug. 9, 1977 relates to a security lock and key having several advantages over the prior art, but in certain applications, other features for ease of use are believed to be desirable.

SUMMARY OF THE INVENTION

One improvement of the present invention resides in providing the plunger of a plunger-type lock with a shallower bore area than that of our prior U.S. Pat. No. 4,040,279 for gripping by radial wedging motion of the fingers while retaining the advantages of the lock of said prior application. A generally cylindrical eyelet is positioned next to the plunger cylinder. The eyelet has a bore coaxially aligned with the bore of the plunger cylinder and a radial flange against which the locking spring presses. Attempts to draw the plunger to unlocking position by unauthorized entry are thwarted because the eyelet cylinder and not the plunger cylinder will be withdrawn. A spring or flexible element holds back the plunger cylinder when the eyelet is pulled away from the plunger cylinder.

In the aforesaid U.S. Pat. No. 4,040,279, the preferred means for actuating the tubular sleeve and engaging fingers in using the key comprised a rotatable thumb screw. The present invention provides a quicker and easier to use actuation means comprising a toggle-type camming lever. The lever operates to pull outward on the tubular sleeve for unlocking operation.

In the key body according to our said prior patent there are two bias springs, one tending to oppose retraction of the tubular sleeve, and a second opposing the retracting movement of the spreading engagement fingers so that those fingers do not move along with the tubular sleeve until after the finger ends are wedged into tight frictional engagement between the flared end of the sleeve and the wall of the plunger cylinder bore. In accordance with the present invention, there is only one coiled spring within the key body, cooperating with a collar member that allows the tubular sleeve to be drawn along under the action of the actuating lever the controlled distance to spread apart the engaging fingers into wedging, gripping position before the fingers are retracted toward the head of the key to retract the plunger cylinder towards the unlocked condition.

In the key of our said prior patent, a spring under compression in the actuating thumb screw permitted some freedom of axial movement of the central rod-like member to accomodate dimensional variations in locks, etc. The toggle-like camming lever of this invention preferably incorporates a relief spring for the same purpose, i.e., to permit some "floating" motion of the central, otherwise stationary, rod-like member.

The improved lock of the present invention preferably incorporates a frangible pin-like member for installation without using a key, as described in our said prior patent.

The foregoing and other improvements and advantages in the security lock and key will be more fully understood from the following detailed description of the invention, especially when that description is read with reference to the accompanying drawing figures.

BRIEF DESCRIPTION OF THE DRAWINGS

In the drawing figures in which like reference characters denote like parts throughout.

DETAILED DESCRIPTION OF PREFERRED EMBODIMENTS

Figure 1:
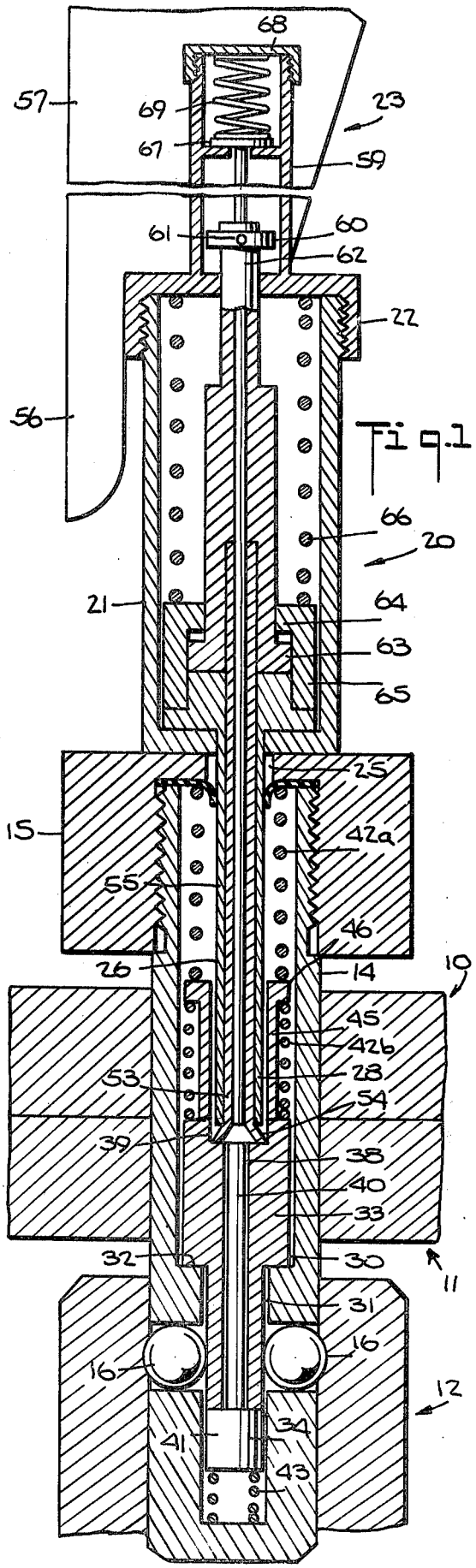
FIG. 1 is a sectional view of a key according to the invention inserted in the lock of the invention at the commencement of the lock opening procedure. Part of the lock is not shown and some details have been omitted for clarity.

The improved security lock of the present invention is illustrated in FIGS. 1–3 and 6 of the accompanying drawings as applied to hold two arms 10 and 11 such as those of a valve or meter security assembly in registering relationship by using a removable cap member generally designated 12, but it should be understood that the lock can be used for all of the various kinds of applications in which plunger-type locks having retractible locking balls are presently employed, as well as other applications.

The improved lock of the invention has a shank 14 shown passing through aligned holes of the arms 10 and 11 and retained in place by the permanently secured enlarged head 15 of the lock and the removable cap 12. When the radially extensible locking balls 16 of the lock are in the position shown in FIGS. 1, 2 and 6, the cap 12 is firmly locked in place on the shank 14; but when the balls 16 are free to move radially inward as shown in FIG. 3, the cap 12 is released and the shank 14 can be withdrawn from its locking position. The shank 14 and head 15 of the lock as well as the cap 12 are preferably formed of hardened steel to deter brute force efforts to remove the lock, the only point of attack on the lock being its keyhole 25, which can be protected in accordance with our prior invention of U.S. Pat. No. 4,040,279.

Figure 2:
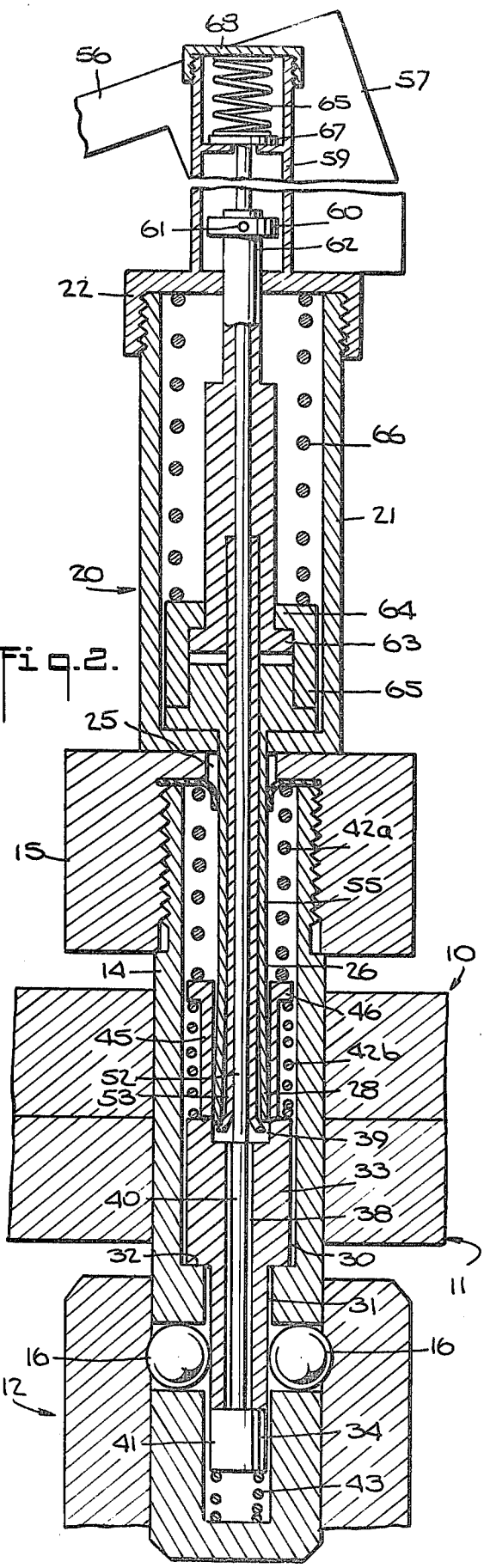
FIG. 2 is a view similar to that of FIG. 1 with key fingers spread into lock opening, gripping engagements with a plunger cylinder.
Figure 3:
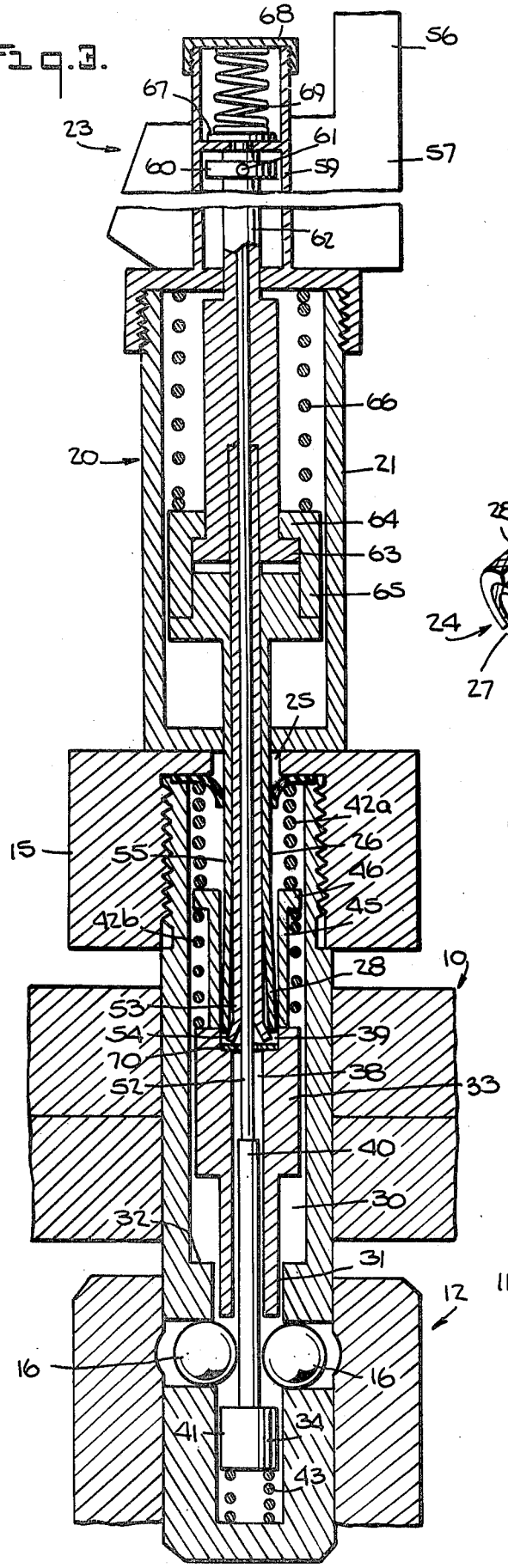
FIG. 3 is a view similar to those of FIGS. 1 and 2 showing the key and lock at the completion of the unlocking process.
Figure 4:
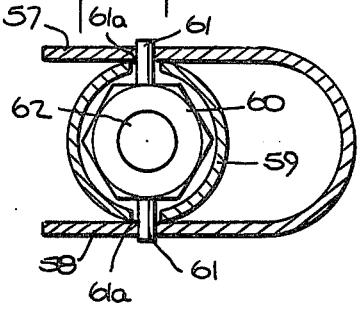
FIG. 4 is a top view in detail of the key handle according to the invention.

The key of the invention, generally designated 20 in FIGS. 1, 2 and 3, has a generally cylindrical handle portion 21 with a fixed cap 22 and a toggle-type operating lever mechanism generally designated 23.

Figure 5:
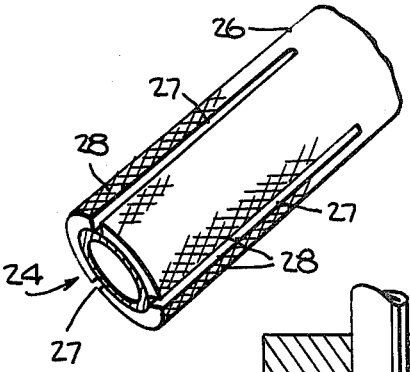
FIG. 5 is a detail view of the operating end of the key.
Figure 6:
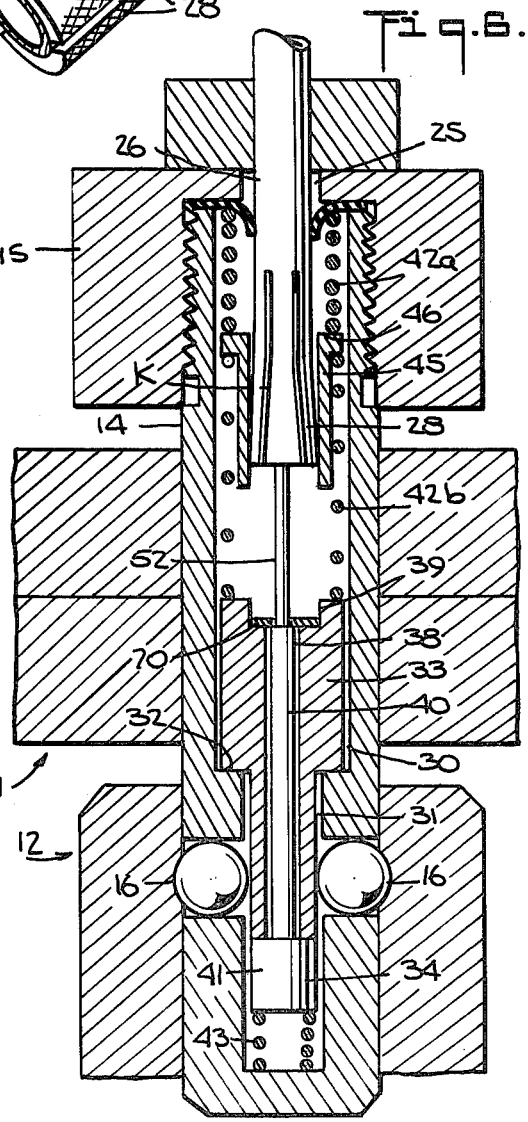
FIG. 6 shows the result when an unauthorized key is used in an attempt to open the lock of the invention

The operating end of the key 20 which is inserted into the keyhole 25, has an external cylindrical member 26 split by slots 27 at its operating end into three fingers 28, which generally extend through an arc of about 120 degrees, as shown in detail in FIG. 5. The fingers 28 are somewhat springy and flexible for frictional engagement to open the lock.

After insertion of the operating end 24 of the key 20 into the keyhole 25 as shown in FIG. 1, the lever mechanism 23 is moved to the position shown in FIG. 2, and then to the position of FIG. 3, whereupon the steel balls 16 are released to move inward to open the lock.

As shown in FIGS. 1–3 and 6, and in accordance with our prior U.S. Pat. No. 4,040,279, the generally cylindrical shank 14 has an axial bore 30, one portion 31 of which is of reduced diameter to provide an internal shoulder 32, the keyhole 25 being narrower than the bore 30, but wider than the portion 31. Slidably fitted within the bore 30 are cylinder member 33 and piston 34.

The piston 34 and cylinder 33 constitute a compound plunger mechanism, the piston 34 having an elongated shaft portion 40 slidably received in a central axis bore 38 of the cylinder 33 and a piston head 41 of the same diameter as the cylinder 33 adjacent said piston head 41. As explained in U.S. Pat. No. 4,040,279, the lock of the invention can only be opened by exerting force to hold the piston 34 in place while simultaneously retracting the cylinder 33 to open up a space into which the steel balls 16 can retreat to disengage from a cooperating groove or recess. The improved lock of this invention has an anti-tamper spring 43 pressing against the piston head 41 as in U.S. Pat. No. 4,040,279, but differs from the lock of said prior patent in the spring arrangement at the end of the cylinder 33 opposite the piston head 41, the improved lock of this invention having an additional tamper defeating element in the form of an eyelet 45 interposed between the cylinder 33 and the keyhole 25. The eyelet 45 is generally tubular, with an outwardly extending lip or flange 46 at the end of the eyelet 45 remote from the cylinder 33. The other end of the eyelet 45 normally abuts against the cylinder 33 surrounding a socket area 39 of the cylinder 33, which socket area must be engaged by the key for lock-opening withdrawal of the cylinder 33. It should be noted that the socket area 39 according to the improvement of this invention can be considerably shallower than the corresponding socket area shown in our prior patent making it more difficult to engage the socket area 39 with an unauthorized key or fabricated picking tool.

A coiled locking spring **42*a* is compressed between the eyelet rim 46 and the head 15 of the lock, pushing the eyelet 45 and the cylinder 33 toward locked position. A second locking spring 42*b* is compressed between the lower side of the eyelet rim 46 and the cylinder 33. The eyelet 45 and springs 42*a* and 42*b*** cooperate in thwarting tampering through the use of an unauthorized key in the manner shown in FIG. 6, wherein an unauthorized key K, somewhat similar to the key of the invention has been inserted in an attempt to open the lock. The key K has failed to grip the socket area 39 because of slippage or other factors and has instead engaged the eyelet 45 and partially withdrawn the eyelet 45, leaving the cylinder 33 and piston 34 in locking condition. The spring 42*b*, opening from its compressed state, has continued to depress the cylinder 33 as the eyelet 45 has been retracted by the unauthorized key K. Of course, the authorized key would be operative to open the lock by gripping the socket 39 and retracting the cylinder 33 and eyelet 45 while holding back the piston 34.

The improved lock of the present invention can be more highly discriminating and less tolerant of variations in key dimensions than the lock of our prior U.S. Pat. No. 4,040,279 because of the limited depth and controlled diameter of socket 39, and controlled axial movement of fingers 28 by the internal collar of the key, but this does not require that either of the springs 42*a* or 42*b* must be of such length as to involve manufacturing or operating difficulties.

The improved key 20 of this invention differs from the key of U.S. Pat. No. 4,040,279, not only in the employment of a lever instead of a thumbscrew, either of which can be captive to the key, but also in the elimination of one of the springs of the key of our prior application. It will be understood from the following description, that the improved key will cooperate particularly effectively with the improved lock shown and described herein because of its effective engagement with a socket 39 to offer the user multiple combinations of the locking system.

The improved key of the invention, as illustrated in FIGS. 1–3, has a central rod-like member 52 for holding down the lock piston 34, closely yet slidably surrounded by a tubular sleeve 53 having a flared or bell-like end portion 54, all as in U.S. Pat. No. 4,040,279, for spreading the fingers 28 of the cylindrical member 55 which concentically encompasses the sleeve 53 when the tubular sleeve 53 is drawn up between the fingers 28 and the central rod-like member 52 to engage the socket 39 as shown in FIGS. 2 and 3. This operating end of the key 20 is similar to the key of our prior patent. However, the mechanism for actuating the operating elements of the key 20 differs from that of our said prior application, in that the lever mechanism 23 is employed in cooperation with internal parts within the body 21 for quick operation.

The lever 23, as shown in FIGS. 1–4, has an elongated arm 56 for manipulation and a body portion formed with two parallel sides 57, 58. Situated between the sides 57 and 58 is a generally cylindrical housing 59, within which housing 59, a hex nut 60 is mounted to slide toward and away from the key cap 22 on a pair of pins 61 fitted in slots 61*a* of the housing 59 and journalled in the sides 57 and 58 for movement by the camming action of the lever 23. The nut 60 moves up and down as camming surfaces of the lever 23 engage the outer surface of the key cap 22, holding the lever 23 in its various operating positions as shown in the drawing. The nut 60 encircles a generally cylindrical element 62 secured to the tubular sleeve 53 and axially movable therewith. The member 62 has a stepped radially extending lip 63 for cooperation with inwardly extending lip 64 of a generally cylindrical collar 65 slidable axially within the key body 21. The mating lips 63 and 64 cause the elements 62 and 65 both to be biased away from the key cap 22 by the action of a coiled spring 66 under compression between the key cap 22 and the collar 65.

Movement of the lever 23 from the position of FIG. 1 to that of FIG. 2 brings the cylindrical element 62 axially upward, moving the lips 63 and 64 from a controlled spaced relationship into engagement, and also draws the tubular sleeve 53 toward the lever 23 against the opposition of the spring 66 so that the flared end 54 spreads apart the fingers 28 to engage the socket 39.

The controlled space or gap shown between the lips 63 and 64 in FIG. 1 will be seen to be equal to the distance of the flared end 54 moves to spread the fingers into socket-engaging condition in FIG. 2.

It will be seen that if the space or gap between the lips 63 and 64 were smaller than the controlled space distance shown in FIG. 1, the spreading of the fingers 28 by the flared end 54 would be reduced or limited accordingly. If the preset space between the lips 63 and 64 were increased the flared end 54 would be drawn up further between the fingers 28. Thus by selection of the spacing of the lips 63 and 64 in the key condition of FIG. 1, the key can be dimensioned to engage a socket 39 of selected diameter, and will not engage a larger diameter socket 39. This improvement in plunger-type locks and keys permits the manufacture of multi-combinations, using the controlled space between the lips 63 and 64, variations of the length of key fingers 28, the depth of socket 39 and the bore diameter of the socket 39, effectively allowing utilities or other users to optimize the application of barrel lock security systems. For example, utilities in contiguous areas can employ mutually incompatible locks and keys, or several different sets of keys can be distributed, not all of which will serve to open all locks in a given area.

The split cylinder 55 which constitutes the fingers 28 is also movable in the upward direction in the drawings as shown in FIG. 3. The central rod-like member 52 extends slidably centrally through the members 53 and 62 to protrude above the end of the member 62 and nut 60 at the lever 23. The central member 52 terminates at its outer end in a disc-like head 67 closely slidable within the cylindrical housing 59. Between this head 67 and a cap 68 of the housing 59 there is provided a coiled relief spring 69, serving to allow some degree of retraction of the central rod-like member 52. This relief spring 69 prevents damage to the rod-like member 52 when the end thereof forcibly abuts against the piston 40 of the lock, or is jammed against foreign matter in a lock.

FIG. 1 shows the initial position of the key 20 after insertion in the lock but before key operation. In FIG. 2 the lever has been moved, bringing the fingers 28 into grasping engagement. Movement of the lever to the position of FIG. 3 withdraws the cylinder 33 while the central rod-like member 52 holds back the piston 34, freeing the locking balls 16 to retreat and opening the lock.

FIG. 3 illustrates a further improvement which can be employed in the lock of the invention. A washer-like element 70 can be seated within the cylinder socket 39 to restrict access to the piston shaft 40, so that only a rod-like member 52, smaller than a central opening in the member 70 can engage and hold back the piston 34 for retraction of the cylinder 33 while holding the piston 34 in place to open the lock. The member 70 can be of rubber or plastic, wedged or glued in place at the bottom of socket 39.

Various modifications substitutions and adaptations of the improved lock and key of the invention will suggest themselves to those acquainted with the art, and are considered to be within the spirit and scope of the invention.

What is claimed is:

1. In a key, for a plunger-type lock, of the type having a rod-like member and a plurality of spreadable fingers for retraction of a movable lock element, an operating cam lever, and a relief member for said rod-like member in a housing having slots, and means pivotally connected to said lever and extending through said slots for moving the key fingers.

2. In a key according to claim 1, and wherein the fingers are spread by relative movement of a member between said fingers and said rod-like member, a first sliding member secured to the rod-like member and movable therewith, a second sliding member secured to said fingers and movable therewith, and collar means associated with said sliding members for allowing said first sliding member to move some distance while restraining said second sliding member against motion.

3. In a key according to claim 1, first and second generally annular members mounted to slide axially within a key handle, and a collar member mounted to engage a radial lip of one of said sliding members.

4. In combination with a plunger-type lock of the type having a generally cylindrical plunger to be retracted for unlocking by engagement of socket means in the plunger, an eyelet member adjacent to and generally axially aligned with said socket means, so that an unauthorized key will engage said eyelet member rather than said socket means.

5. The combination of claim 4 and including one spring biassing said eyelet toward said plunger and another spring, weaker than said one spring, opposing retraction of said plunger when said eyelet member is engaged and retracted.

6. The combination of claim 4 wherein said eyelet member is spring biased toward said plunger.

7. The combination of claim 6 and including spring means opposing retraction of said plunger when said eyelet member is retracted.

8. A key comprising a central rod-like member, a tubular sleeve having an enlarged end and slidable along said rod-like member, and a plurality of fingers mounted around said enlarged end between said fingers and said rod-like member, and collar means for limiting retracting motion of said enlarged end relative to said fingers to control spreading of said fingers.

9. A key comprising a central rod-like member, a tubular sleeve having an enlarged end and slidable along said rod-like member, and a plurality of fingers mounted around said enlarged end between said fingers and said rod-like member, and means for limiting retracting motion of said enlarged end relative to said fingers to control spreading of said fingers, the means for limiting retracting motion comprising a collar within a body of the key for permitting movement of said fingers in the direction of retraction, after limited spreading of said fingers.

10. A key comprising a central rod-like member, a tubular sleeve having an enlarged end and slidable along said rod-like member, and a plurality of fingers mounted around said enlarged end between said fingers and said rod-like member, and means for limiting retracting motion of said enlarged end relative to said fingers to control spreading of said fingers and including a collar within a body of said key normally spaced by a pre-set distance from means connected with said sleeve for restraining retracting movement of said fingers until said enlarged end has been retracted.

11. The key of claim 10 wherein said retracting movement of said fingers is effected only after said enlarged end has been retracted by a distance related to said pre-set distance.

12. The key of claim 8, and including an operating lever for retracting said sleeve and relief means permitting adjusting movement of said rod-like member.

13. The key of claim 12, wherein said operating lever has camming surfaces for holding said sleeve in various positions.

14. In combination with a plunger-type lock having a plunger with a socket and an axial bore opening on to said socket a washer-like element seated in said socket for permitting access to means in said bore only by key elements compatible with an opening of said washer-like element.

15. The combination of claim 14 wherein said washer-like element is secured in place at a bottom of said socket.

16. A key of the type which unlocks a plunger-type lock by expansion of means at an operating end of the key and retraction of a plunger, including a collar within a body of the key for permitting retraction only after a predetermined degree of expansion.

17. A key for opening a plunger-type lock by engagement with and retraction of a plunger, said key comprising a body, a collar within said body, and plunger engagement means, said collar being normally spaced by a pre-set distance from means connected to said plunger engagement means for restraining retracting movement until said means connected to said plunger engagement means has moved a predetermined distance relative to said collar.

* * * * *